United States Patent [19]

Stoever et al.

[11] Patent Number: 4,716,933

[45] Date of Patent: Jan. 5, 1988

[54] VALVE UNIT

[75] Inventors: Guy T. Stoever, Rock Island; David W. Swaim, Coal Valley, both of Ill.

[73] Assignee: J. I. Case Company, Racine, Wis.

[21] Appl. No.: 919,533

[22] Filed: Oct. 16, 1986

[51] Int. Cl.[4] ..... F15B 13/02

[52] U.S. Cl. ..... 137/596.2; 91/446; 91/447; 137/596; 137/596.13

[58] Field of Search ..... 91/446, 447; 137/117, 137/596.13, 596.2, 596

[56] References Cited

U.S. PATENT DOCUMENTS

| | | | |
|---|---|---|---|
| 3,602,243 | 8/1971 | Holt et al. | 137/596.12 X |
| 4,011,891 | 3/1977 | Knutson et al. | 137/625.64 X |
| 4,290,447 | 9/1981 | Knutson | 91/447 X |
| 4,434,966 | 3/1984 | Zajac | 137/625.64 X |
| 4,555,976 | 12/1985 | Wolfges | 91/447 X |
| 4,569,273 | 2/1986 | Anderson et al. | 91/447 |

OTHER PUBLICATIONS

Kishor Patel, "Pressure Compensated Electro-Hydraulic Proportional Flow Control Valve", Sep. 1978, SAE Technical Paper No. 780747.

Dynex/Rivett Inc., Bulletin VP 0478, "Proportional Control Valves".

*Primary Examiner*—Gerald A. Michalsky

*Attorney, Agent, or Firm*—Cullen, Sloman, Cantor, Grauer, Scott & Rutherford

[57] ABSTRACT

A valve unit for use in a load sensing system having a fluid operated cylinder. The valve unit permits positioning of an implement between the raise, lower, neutral and float positions and also provides for throttling of fluid flow to the cylinders as well as priority flow to the system. Float is obtained through a lock check valve which includes a main poppet maintained in a seated position by a spring biased pilot poppet. A pilot piston is positioned coaxially opposite the main poppet and is responsive to fluid pressure in the valve to act upon the pilot poppet and unseat the main poppet. In the float position, the fluid pressure within the valve may be stand-by pressure which acts upon the pilot piston to allow it gradual decent of the implement. The pilot pressure is communicated to the pilot piston through a centrally located passage. The location of the passage permits additional lock check valves to be easily added as needed. An adjustable priority flow control valve is included in the valve body for manual adjustment of the priority in the system and the flow rate of fluid.

6 Claims, 5 Drawing Figures

VALVE UNIT

BACKGROUND

The present invention relates to a valve unit for use in controlling a fluid cylinder in a load sensing system. More particularly, the present invention relates to a selectively controlled valve unit having a priority flow valve that is manually adjustable and at least one lock check valve that is automatically responsive to fluid pressure within the system. A centrally located fluid passage within the valve unit supplies pilot or control fluid to the lock check valve. The location of the passage permits additional lock check valves to be easily installed.

In a typical valve unit, there is an inlet port connected to a fluid pump and a control spool to direct pressurized fluid from the pump to a fluid cylinder. The valve unit has raise, lower and neutral positions and is commonly used on, as for example; loaders, back hoes and agricultural implements.

A disadvantage of this conventional type of valve is the lack of a "float" position. Float is the ability of an implement to move gradually in either direction under its own weight, as for example, a large agricultural implement may float from a raised position to the transport position. Ordinarily, a separate mechanism is required to cause the float action which is inconvenient for the operator of the vehicle.

Another disadvantage of the typical valve unit is the inability to determine priority of fluid flow. Many valve units have priority valves to insure that one section of the system is satisfied before fluid is directed to another section. This priority is fixed and cannot be adjusted.

SUMMARY OF THE INVENTION

The present invention overcomes the above disadvantages by providing a single valve unit which can be shifted to the float position and can be adjusted to vary the amount of priority flow.

The valve unit has a single valve body with an inlet port connected to a fluid pump for receiving the fluid output of the pump and cylinder ports connected to a fluid cylinder. An adjustable priority valve is positioned within the body and is connected to the inlet port for controlling the priority of flow to the system. A manually positionable control spool is slideably mounted within the valve body and interconnects the priority valve and the cylinder ports for selective operation of the cylinder. In addition to the common raise, lower and neutral positions, the control spool can be shifted to the float position.

The valve unit includes a lock-check valve having a main poppet slideably mounted within a sleeve positioned within the valve body between the control spool and at least one of the cylinder ports. A spring biased pilot poppet is slideably mounted within the main poppet to bias it toward a seated position to close off flow to the cylinder port. A pilot piston is slideably mounted within a bore coaxially opposite the poppet sleeve and is actuated by pressure within the valve for engagement with the pilot poppet to permit flow into and out of the cylinder port. A centrally located passage supplies pilot pressure from the valve unit to the pilot piston. The location of the passage allows additional lock check valves to be easily installed.

The lock check valve enables the valve unit to be shifted to the float position. Standby pressure within the system acts upon the pilot piston causing it to slide within the bore which moves the pilot poppet away from the main poppet. With the pilot poppet displaced, fluid pressure created by the weight of the implement unseats the main poppet permitting fluid in the cylinder to flow to reservoir. Further, in the raise and lower positions, the pressure within the system actuates the lock check valve to permit fluid to flow into or out of the port as required. In the neutral position, the main poppet remains sealed to reduce leakage from the cylinder.

Other advantages and meritorious features of the valve unit of the present invention will be more fully understood from the following description of the invention, the appended claims and the drawings, a brief description of which follows.

DETAILED DESCRIPTION OF THE INVENTION

Figure 1:
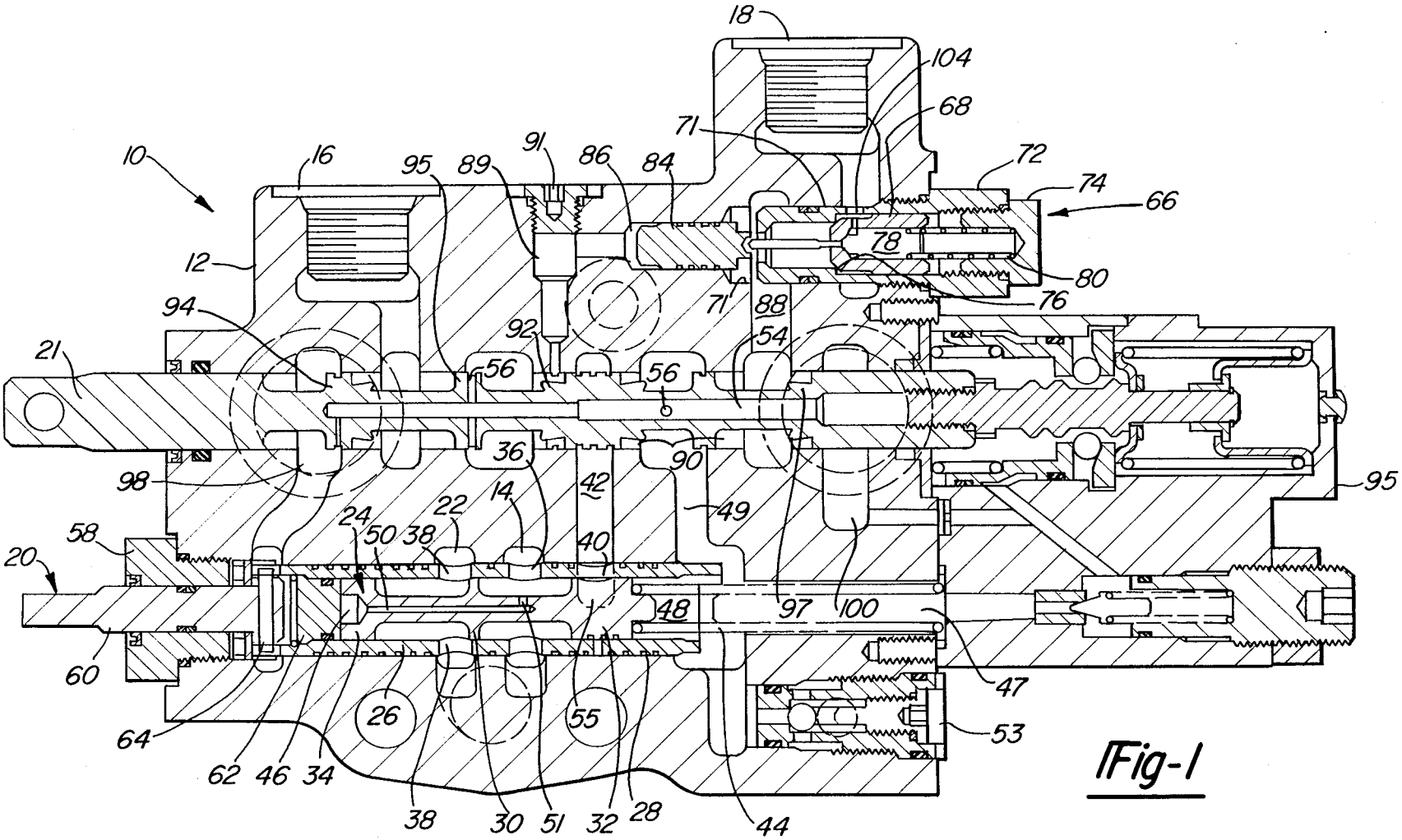
FIG. 1 is a cross sectional view of the valve unit of the present invention in the neutral position.

With reference to FIG. 1, the valve unit of the present invention is shown generally at 10 having a valve body 12 an inlet port 14 and cylinder ports 16 and 18. Inlet port 14 is connected to a variable displacement pump (not shown) for receiving the fluid output of the pump. Cylinder ports 16 and 18 are connected to opposite ends of a fluid cylinder (not shown).

An adjustable priority flow control valve 20 is connected to inlet port 14 to initially direct fluid to ports 16 and 18 as required by main control spool 21, then to direct any excess fluid to port 22 which is connected to the remainder of the system. Control valve 20 has a modulating spool 24 slideably mounted within a rotary sleeve 26 that is coaxially positioned within a bore 28 in valve body 12. Spool 24 has a land 30 at its midpoint and lands 32 and 34 on each end.

Sleeve 26 has a first set of metering orifices 36 which permit uninterrupted communication of fluid from inlet port 14 to the interior of sleeve 26. The fluid is then directed by the modulating spool 24 to either a second set of orifices 38, which are in communication with outlet port 22, or to an opening 40 in sleeve 26, which is a communication with channel 42, or to both orifices 38 and channel 42 simultaneously.

The position of spool 24 is determined by a compensating spring 44 and fluid pressure within chamber 46 and 48. Spool 24 has a bore 50 and port 51 to communicate pressure from inlet port 14 to chamber 46. Spool 21 has an elongated bore 54 and ports 56 for communicating a pilot pressure to chamber 48 through channel 49. Fluid can also be directed to chamber 48 from channel 42 depending upon the position of spool 21.

Spool 24 is illustrated in a zero pressure position in each of the FIGS. 1–5, however, its actual position when main spool 21 is shifted between "raise", "lower", and "float" will be described as follows. Initially, upon fluid demand at port 16 or 18, the fluid pressure in chamber 46 is greater than the combined pressure of spring 44 and the fluid in chamber 48. This urges spool 24 to the right in FIG. 1 in the direction of chamber 48 to open flow to channel 42. Flow to outlet 22 is prevented by land 30. As flow continues, the fluid pressure in chamber 48 increases to stop further movement of spool 24 so that all available fluid is delivered to either port 16 to 18.

When demand at port 16 or 18 has been satisfied, the pressure in chamber 48 remains constant but the pressure in chamber 48 may continue to increase depending upon demand in the system and the capacity of the pump. If the pressure does increase, spool 24 will continue to move to the right toward chamber 48 to permit flow around land 30 between inlet 14 and outlet 22 supplying fluid to the remaining system. If there is no demand at ports 16 and 18 but there is demand in the remainder of the system, the pressure in chamber 46 will push land 30 past metering orifice 36 to prevent fluid flow to channel 42 so that all available fluid is directed to outlet 22 and the remainder of the system. A stop 47 is provided in chamber 48 to prevent over travel of spool 24.

The priority and rate of flow of control valve 20 can be manually adjusted by turning rotary sleeve 26. Opening 40 in sleeve 26 extends circumferentially over one half of sleeve 26 and the opening 55 in bore 28 to channel 42 has a radius approximately equal to the radius of opening 40. By turning sleeve 26, opening 40 can be partially or wholly closed by the wall of bore 28 opposite the opening 55. By varying the size of opening 40 the relative pressures in chambers 46 and 48 are varied to change the priority of the valve. Rotating sleeve 26 through 180° will close opening 40 to direct all flow to outlet 22. To adjust sleeve 26, a stem 60 is provided. Stem 60 is connected to sleeve 26 through a tightly fitted plug means 62 and connecting pin 64.

To control the passage of fluid into and out of port 18, a lock check valve 66 is provided. Valve 66 has a main poppet 68 slideably mounted within a housing 72 which is received within a bore 71 in body 12. Main poppet 68 has a beveled front face which is biased to a seated position against a valve seat 76 by a spring-biased pilot poppet 78. Pilot poppet 78 is slideably mounted within main poppet 68 and has one end connected to a spring 80 which is mounted in a cavity 82 in plug 74. A pilot piston 84 is slideably mounted within a bore 86 coaxially opposite housing 72. A passage 89 interconnects bore 86 with bore 90 to deliver pilot pressure to pilot piston 84. Passage 89 is centrally located within the valve body 12 between outlet ports 16 and 18. This enables additional lock check valves to be readily added if necessarily. A plug 91 is provided in passage 89.

Figure 5:
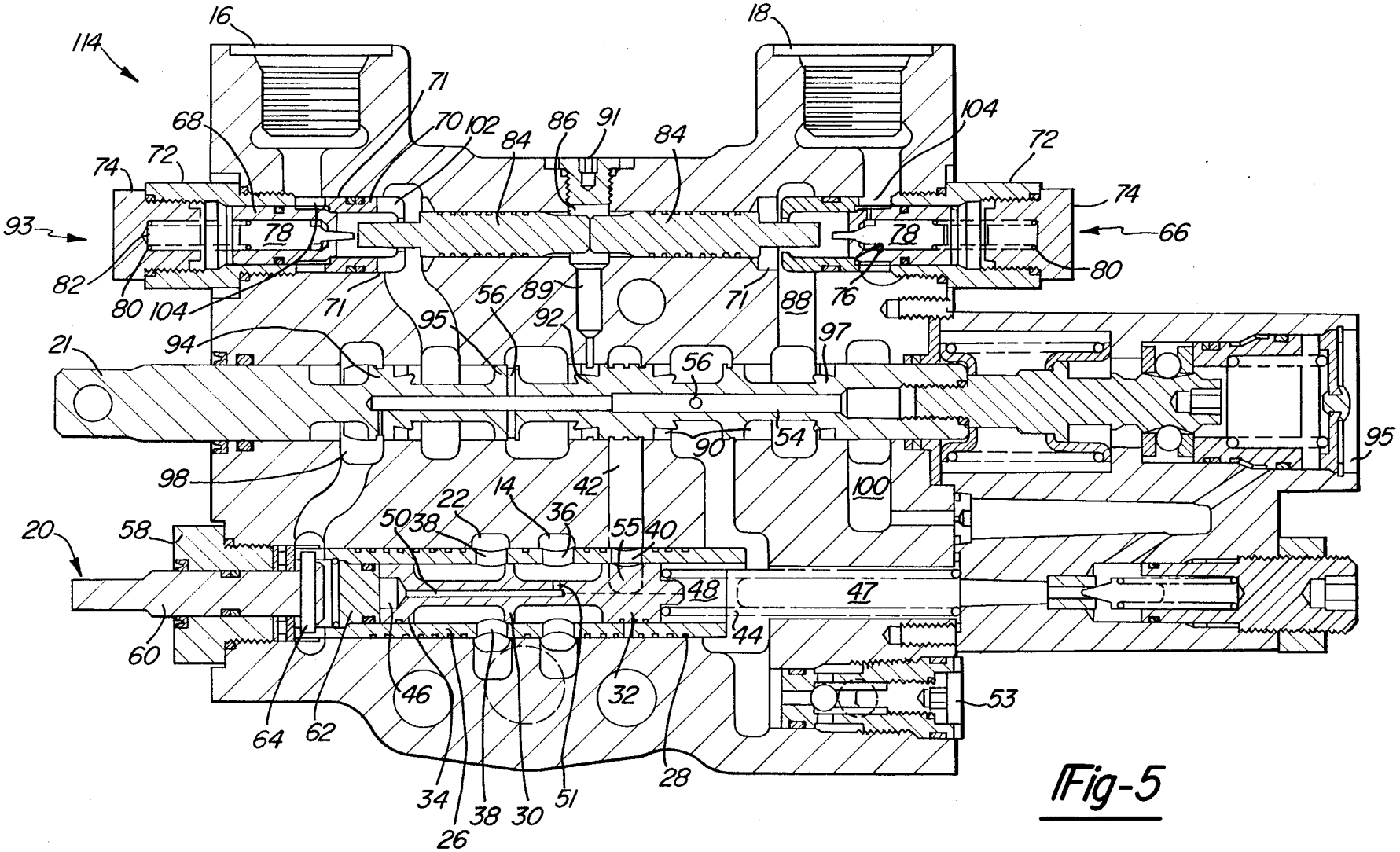
FIG. 5 is a cross sectional view of the valve unit employing dual lock-check valves.

By simply drilling an additional bore through valve 10 and into central passage 89, a lock check valve can be added to port 16. With reference to FIG. 5, a valve 114 having a second lock check valve 93 is illustrated. Of course, if there are several outlet passages a lock check valve can be added to each outlet passage as needed.

With reference to FIGS. 1 through 4, the operation of the lock-check valve will now be described. In FIG. 1, the valve unit 10 is illustrated in the neutral position with land 32 and land 92 closing both ends of channel 42. Due to the lack of fluid pressure in passages 88 and 89, main poppet 68 is urged by pilot poppet 78 to the seated position closing off port 18 to reduce leakage. Lands 94 and 97 on spool 21 prevent fluid in ports 16 and 18 from passing to reservoir ports 98 and 100. A detent assembly 95 is provided to retain control spool 21 in the selected position.

Figure 2:
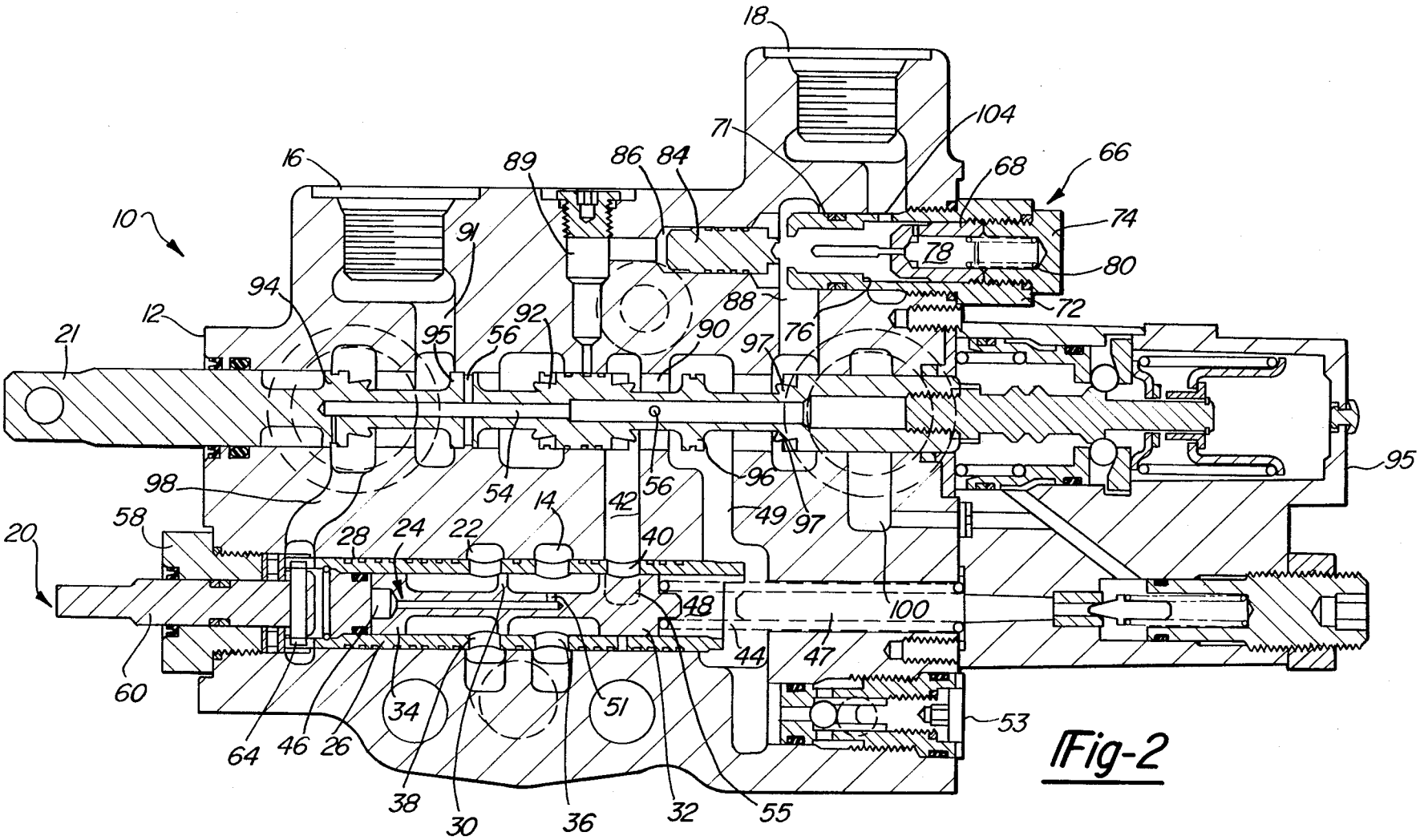
FIG. 2 is a cross sectional view of the valve unit in the raise position.

With reference to FIG. 2, spool 21 has been moved to the raise position. Spool 24 directs fluid from inlet 14 to channel 42 then around lands 96 and 97, through passage 88 into housing 72. If the fluid pressure in housing 72 is greater than the bias of spring 80, it will unseat main poppet 68 and open aperture 104 permitting passage of fluid to port 18. Fluid flow from inlet 14 to cylinder port 16 is blocked by land 92; however, fluid in port 16 from the cylinder (not shown) is directed past land 94 to reservoir port 98. Additionally, land 92 blocks flow to passage 89.

Figure 3:
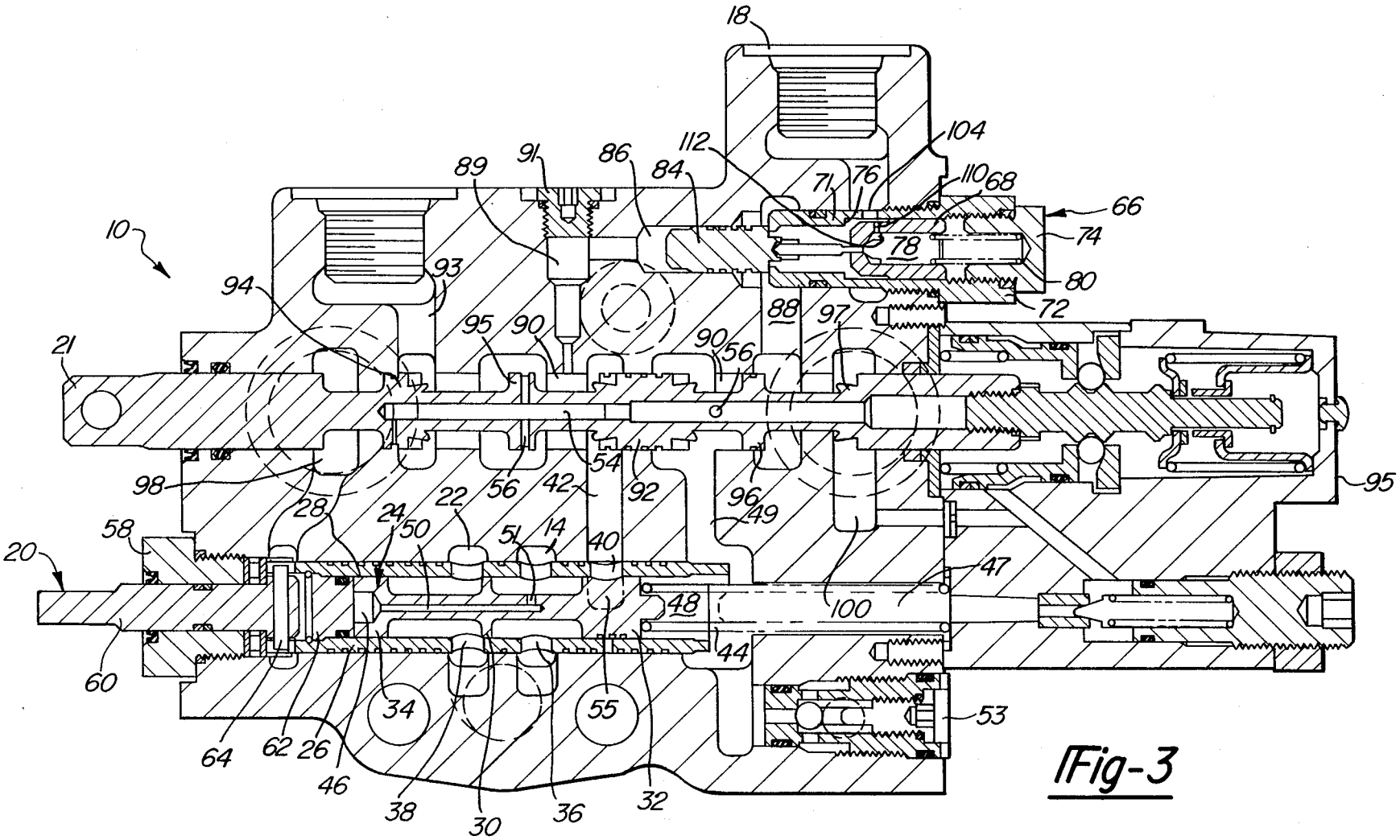
FIG. 3 is a cross sectional view of the valve unit in the lower position.

Referring now to FIG. 3, spool 21 has been moved to the lower position. Spool 24 directs fluid from inlet 14 through channel 42, bore 90 and passage 93 into cylinder port 16. Fluid is also directed into passage 89 which forces pilot piston 84 against pilot poppet 78 pushing it against spring 80. When the pressure in passage 89 exceeds the bias of spring 80, pilot poppet 78 will be displaced which allows the fluid in port 18 to unseat main poppet 68 permitting fluid to flow from cylinder port 18 to reservoir port 100. A small port 110 is provided in main poppet 68 for permitting fluid to flow into a chamber 112 defined by the interior of main poppet 68 and pilot poppet 78. This chamber of fluid permits smooth movement of main poppet 68. Without chamber 112, main poppet 68 could chatter when moving in housing 72.

Figure 4:
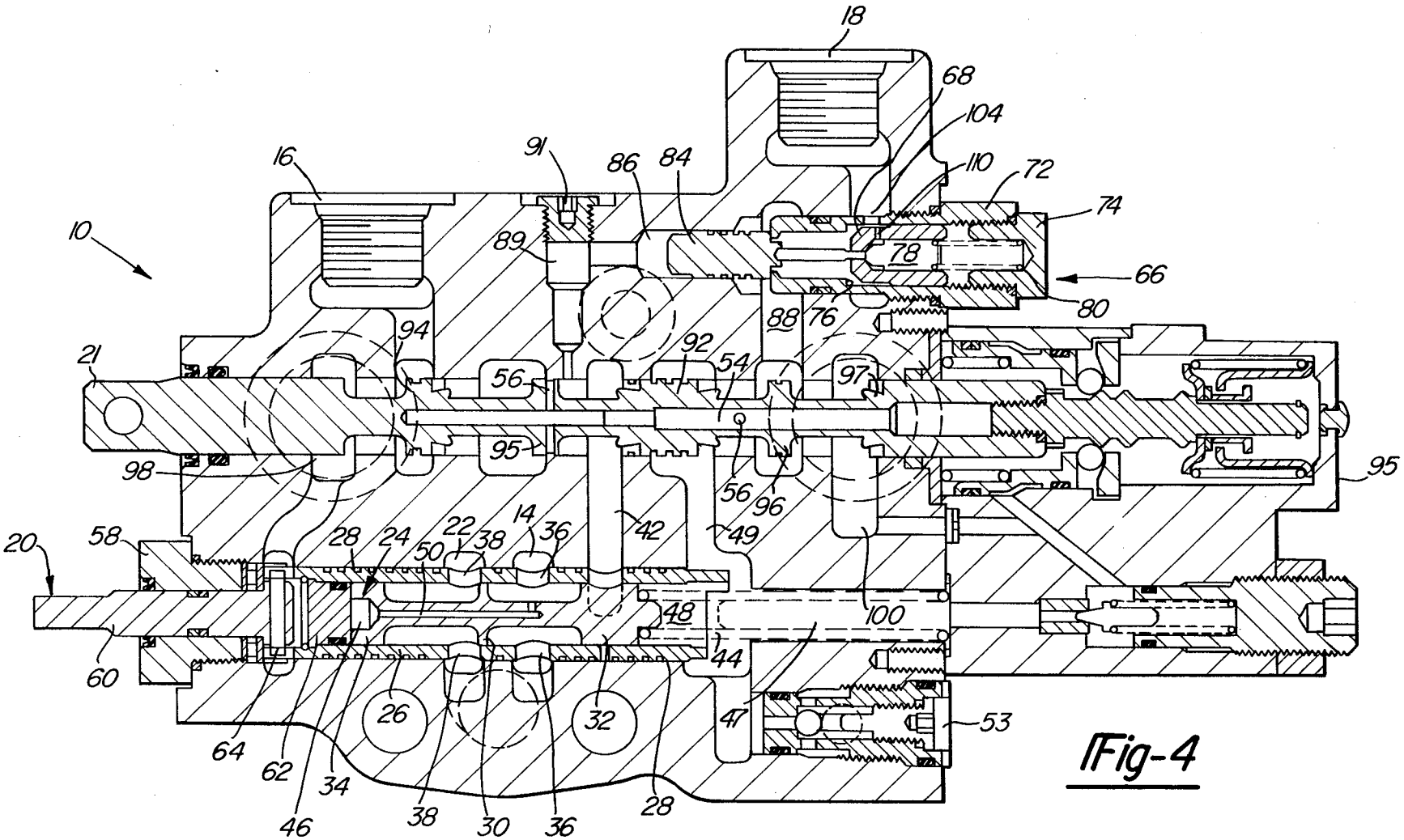
FIG. 4 is a cross sectional view of the valve unit in the float position.

Referring now to FIG. 4, valve 21 is positioned in the float position. In this position, lands 92 and 95 block flow from inlet 14 to ports 16 and 18, while permitting flow into passage 89. Lands 94 and 96 permit fluid in ports 16 and 18 to pass to reservoir ports 98 and 100. The pressure in channel 42 is permitted to flow through passage 89 into bore 86 to force pilot piston 84 against pilot poppet 78. In the preferred embodiment, this pressure is stand-by pressure within the system which is slightly greater than the bias of spring 80. Upon movement of pilot poppet 78, the fluid pressure in port 18 is directed past the beveled face of main poppet 68 through chamber 88 to port 100. The amount of fluid which is permitted to pass to reservoir port 100 and correspondingly the float rate of the implement to determined by the weight of the implement. Therefore, by providing a spring 80 which has a bias which is slightly less than the stand-by pressure of the system, a slow gradual decent of the implement can be obtained.

It will be apparent to those skilled in the art that the foregoing disclosure is exemplary in nature rather than limiting, the invention being limited only by the appended claims.

What is claimed:

1. A valve unit for a load sensing system, said valve unit comprising:

a valve body having an inlet port connected to a fluid pump for receiving the fluid output of the pump and cylinder ports connected to a fluid cylinder;

a flow control valve within the body connected to the inlet port for controlling the flow of fluid to the cylinder ports;

a manually positionable main control spool slideably mounted within a first bore in the body interconnecting the flow control valve and the cylinder ports for selective operation of the cylinder; and a lock check valve having a main poppet slideably mounted within a sleeve positioned within the valve body between the main control spool and at least one of the cylinder ports, a biased pilot poppet slideably mounted within the main poppet to bias the main poppet toward a seated position to close off flow to the cylinder port and a pilot piston slideably mounted within a second bore coaxially aligned with the sleeve;

upon selective movement of the main spool, fluid pressure from the inlet port communicating with the second bore containing the pilot piston for causing the pilot piston to engage the pilot poppet to force the pilot poppet against the bias for unseating the main poppet and opening the port for passage of fluid to a reservoir;

upon further movement of the main spool, fluid pressure from the inlet port acting directly against the main poppet causing the main poppet to unseat for passage of fluid into the cylinder port; and upon further selective movement of the main spool, said pilot poppet engaging said main poppet forcing said main poppet to a seated position to reduce leakage from the cylinder port; and wherein the flow control valve includes a rotatable sleeve having a first orifice communicating the inlet port with the interior of the rotatable sleeve, an opening in the rotatable sleeve communicating the interior of the rotatable sleeve with a passage which is selectively in communication with the cylinder ports, and a second orifice communicating the interior of the rotatable sleeve with an outlet port; and a spool slideably mounted within the rotatable sleeve for directing fluid from the interior to the opening and the second orifice as required, said opening being adjustable upon turning said rotatable sleeve to determine the amount of priority flow between the opening and the second orifice.

2. The valve unit of claim 1, further comprising a pilot passage centrally located between the cylinder ports interconnecting the first bore with the second bore to deliver pilot pressure to the pilot piston.

3. The valve unit of claim 2 wherein the axis of said pilot passage intersecting the axis of said second bore, a second lock check valve having a third bore coaxially aligned with said second bore, and a second pilot piston slideably mounted in said third bore in coaxial relationship to the other pilot piston.

4. The valve unit of claim 1, further including biasing means engaging one end of the spool for biasing the spool toward a position to close off the opening, and a chamber at the opposite end of the spool communicating with the inlet port to urge the spool against the bias to open the opening, the spool including an intermediate land directing flow between the opening and the outlet port depending upon the relative pressures at each end of the spool, the relative pressures being a function of the demand in the cylinder ports and the position of the rotatable sleeve.

5. The valve unit of claim 1, wherein the main poppet includes a small port communicating with a chamber defined by the interior of the main poppet and the face of the pilot poppet.

6. A valve unit for a load sensing system, said valve unit comprising:

a valve body having an inlet port connected to a fluid pump for receiving the fluid output of the pump and cylinder ports connected to a fluid cylinder;

a flow control valve within the body connected to the inlet port for controlling the flow of fluid to the cylinder ports;

a manually positionable main control spool slideably mounted within a first bore in the body interconnecting the flow control valve and the cylinder ports for selective operation of the cylinder; and a lock check valve having a main poppet slideably mounted within a sleeve positioned within the valve body between the main control spool and at least one of the cylinder ports, a biased pilot poppet slideably mounted within the main poppet to bias the main poppet toward a seated position to close off flow to the cylinder port and a pilot piston slideably mounted within a second bore coaxially aligned with the sleeve;

upon selective movement of the main spool, fluid pressure from the inlet port communicating with the second bore containing the pilot piston for causing the pilot piston to engage the pilot poppet to force the pilot poppet against the bias for unseating the main poppet and opening the port for passage of fluid to a reservoir;

upon further movement of the main spool, fluid pressure from the inlet port acting directly against the main poppet causing the main poppet to unseat for passage of fluid into the cylinder port; and upon further selective movement of the main spool, said pilot poppet engaging said main poppet forcing said main poppet to a seated position to reduce leakage from the cylinder port; and wherein the flow control valve includes a rotatable sleeve having an interior in communication with the inlet port and having an opening in communication with a passage in selective communication with the cylinder ports; the opening being adjustable upon turning of the rotatable sleeve to determine the capacity of fluid flow to the system; and a spool having opposed lands, said spool being slideably mounted within the rotatable sleeve with one end of the spool being biased towards a position to close off fluid flow to the passage and with fluid pressure from the inlet being communicated through a pilot orifice within the spool to a chamber at the opposite end of the spool to urge the spool against the bias to open flow to the passage.

* * * * *